US007097144B2

(12) United States Patent
Kohno

(10) Patent No.: US 7,097,144 B2
(45) Date of Patent: Aug. 29, 2006

(54) HANGER

(76) Inventor: Tatsuyuki Kohno, 4-22 Chidoridai, Uchinada-machi, Kahoku-gun, Ishikawa-ken (JP)

( * ) Notice: Subject to any disclaimer, the term of this patent is extended or adjusted under 35 U.S.C. 154(b) by 333 days.

(21) Appl. No.: 10/259,873

(22) Filed: Sep. 30, 2002

(65) Prior Publication Data

US 2003/0106913 A1 Jun. 12, 2003

(30) Foreign Application Priority Data

Sep. 29, 2001 (JP) ..... 2001-338713

(51) Int. Cl.
*A47G 1/17* (2006.01)
*A41D 27/22* (2006.01)

(52) U.S. Cl. ..... 248/206.5; 248/309.1; 248/683; 223/85

(58) Field of Classification Search ..... 248/206.5, 248/205.1, 309.4, 309.1, 317, 683; 223/85
See application file for complete search history.

(56) References Cited

U.S. PATENT DOCUMENTS 2,731,663 A * 1/1956 Thompson ..... 16/422
3,041,697 A * 7/1962 Budreck ..... 24/303
3,109,619 A * 11/1963 Krug et al. ..... 248/690
3,239,178 A * 3/1966 Pompa ..... 248/205.3
3,245,165 A * 4/1966 Podoloff ..... 40/591
3,331,043 A * 7/1967 Orzabal ..... 335/285
3,365,684 A * 1/1968 Stemke et al. ..... 248/206.5
D229,698 S * 12/1973 Kretzer ..... D13/183
3,827,020 A * 7/1974 Okamoto ..... 248/309.4
4,221,164 A * 9/1980 Krulwich ..... 101/109
4,819,947 A * 4/1989 Mackey ..... 273/412
4,830,321 A * 5/1989 Irie ..... 248/206.5
4,875,654 A * 10/1989 Chandonnet et al. ..... 248/467
4,971,278 A * 11/1990 Woods ..... 248/206.5
5,411,231 A * 5/1995 Buck ..... 248/206.5
5,450,658 A * 9/1995 Hicks ..... 24/303
5,746,329 A * 5/1998 Rondeau ..... 248/206.5
5,895,018 A * 4/1999 Rielo ..... 248/206.5
D438,255 S * 2/2001 Truisi ..... D19/90
6,244,550 B1 * 6/2001 Blatchford ..... 248/222.52
6,352,229 B1 * 3/2002 Adams ..... 248/206.5
6,477,749 B1 * 11/2002 Reiter ..... 24/303
D485,745 S * 1/2004 Sung ..... D8/373
6,811,127 B1 * 11/2004 Shiao ..... 248/206.5

FOREIGN PATENT DOCUMENTS

JP 11-313748 11/1999

* cited by examiner

*Primary Examiner*—Anita M. King
(74) *Attorney, Agent, or Firm*—Wenderoth, Lind,& Ponack, L.L.P.

(57) ABSTRACT

A hanger includes a hanger body having a prescribed external peripheral shape on which clothing is hung up. A first magnet is arranged in a projecting manner on a rear side of the hanger body for attaching the hanger to a prescribed suspending place.

12 Claims, 15 Drawing Sheets

HANGER

BACKGROUND OF THE INVENTION

1. Field of the Invention

The present invention relates to a hanger for suspending clothing to be attached via a magnet to some suspension places such as a wall or a side surface of a locker.

2. Description of Prior Art

A conventional garment hanger used for engaging and suspending clothing has a hook arranged around a top center of a hanger body shaped in an inversed-V shape or substantially equilateral triangle shape, and is used for suspension in engaging the hook with a support bar in a locker or a hook member attached to a wall or the like. Such a garment hanger, however, cannot be suspended at a place, with no support member such as a support bar or a hook member for engaging the hook of the garment hanger, like a wall or a side surface of a locker.

In view of the above, a hooking hanger K, as shown in FIG. 17, has a hook Kf and a magnet provided on the side of the proximal end of the hook. This hooking hanger K is attached via the magnet to a side surface of a steel locker or the like, and is used for suspension in hooking a nape part of a shirt or one part of the waist portion of trousers and a skirt. When this hooking hanger K is used, the hooking hanger K can be attached via the magnet to a place attracted by a magnet even where no support means, such as a support rod, a hook or the like, exists, thereby suspending clothing.

The present inventor previously proposed a hanger with a magnet as disclosed in JP-A HEI 11-313,748. This hanger with the magnet includes a hanger body having a shape of an inverse letter V or substantially equilateral triangle similar to ordinary garment hangers and a magnet buried in the back of the hanger body to be attached to a suspending place, such as a side surface of a steel locker. In use of this garment hanger in the form of the inverse V-shape or substantially equilateral triangular, similarly to use of ordinary hangers, clothing is hung up in a manner matching the shoulders of clothing with the above shaped hanger body, and the hanger body in that state is attached via the magnet to the suspending place. The clothing is suspended by the garment hanger and my be clamped between the magnet and the suspending place. When removing the clothing from the hanger body, the hanger body is detached from the suspending place before the clothing is taken out of the hanger body.

At a hospital, laboratory, site of construction and the like, white overalls and working clothes are used during medical treatments, experiments, research, and construction working, and are taken off and placed anywhere at the time such as, during a meal or going out, and are repeatedly worn and taken off. The white overalls and working clothes once taken off are desirably hung up over a hanger and stored in that state in a locker, etc. from the standpoint of arrangement and good order for prevention of wrinkle formation. Because such white overalls and working clothes, however, are susceptible to attachment of medicine, various germs, dust and perspiration while being worn, it is unsanitary, and storing the white overalls and working clothes together with other clothing is frequently avoided. In addition, since putting on and taking off those clothes is frequently repeated, it is laborious to store them in and take them out from a locker each time. In some cases, the number of lockers is not enough, or lockers have a small accommodation space, resulting in failure to store all white overalls or working clothes. For this reason, once taken off, they are generally hung up over a chair or placed on a desk randomly, resulting in a disorder state with a mess of the white overalls and working clothes. The dust or various germs attached to the white overalls or working clothes may dirty chairs and desks, and winkling may occur when the white overall or working clothes are worn again.

To improve such a situation, the prior art hooking member K or the hanger with the magnet previously proposed by this inventor may be used. In the case of the hooking member K, however, parts of clothing may be overlapped with the part of clothing on the hook Kf as the center. In the case of the hanger with the magnet, clothing is clamped between the hanger body and the suspending place without any gap, so that magnet-equipped hangers do not have good air-permeability to the clothing, thereby raising a problem that the clothing will be subjected to moisture and stacked odor (particularly because water or medicine or perspiration is attached to the white overalls or working clothes). Also, because the prior art uses a strong magnet so that clothing hung up does not fall off, the hooking member K or other hanger may be needed to be strongly pulled when being removed from the suspending place, thereby raising a problem that the removal is not easy. When the hooking member K or hanger with the magnet is attached aslant or upside down to the suspending place, white overalls or working clothes may fall off from the hook Kf or hanger, and in some cases, may be difficult to hang up. Accordingly, when the hooking member K or hanger is attached to the suspending place, it is always necessary to confirm the vertical direction of the hanger and to pay attention to whether the attachment state is inclined, which are laborious matters.

Regarding the hooking member K, because a tip of the hook Kf retains clothing, the clothing tends to be easily subject to wrinkles. When the clothing is hooked on the hooking member K, a tailor's tag or loop attached around a nape portion of a jacket or a waist of trousers is engaged with the hook member Kf. Therefore, the tag or loop may be torn off, while if such a tag or loop cannot be hooked, it is difficult to hook the clothing on the hooking member K. The neck portion or the like may be used for hooking where a tag or loop cannot be used for hooking, but this may cause to extend or break the portion at which the hook member Kf is hooked. Furthermore, it is unstable to hook the hook member Kf with the neck portion and no more than that, and the clothing may gradually move downward and drop as time lapses. Since, in some cases, a penlight or tool for work (e.g., stationary goods or a measuring instrument) is put in a pocket of a white overall or working clothes, the weight of the goods is exerted to the clothing, thereby easily raising such a problem of clothing weight.

Meanwhile, in the case of the prior art hanger with the magnet, when a thick portion of the clothing (e.g., a portion of the collar, pocket, or seam) is placed between the hanger body and the suspending place, or when a locally thick portion is formed due to overlapped parts of clothing, the thick portion may cause the hanger body to float and to drop off from the suspending place. When the hanger body is in the shape of an inversed letter V or substantially equilateral triangle, although the upper clothing of a white overall or working clothes can be hung up over the hanger body, the trousers of working clothes cannot directly be hung up over the hanger body.

It is an object of the present invention to provide a hanger that can be suspended without specially determining a suspending place or suspending direction when clothing is hung up, obtaining a clean suspending state, rendering stable a suspending state of the hanger with respect to the suspending place, and rendering easy removal of the hanger.

SUMMARY OF THE INVENTION

To attain the above object, the present invention provides a hanger including a hanger body having a prescribed outer configuration on which clothing is hung up, and a first magnet arranged in a projecting manner on a rear side of the hanger body for attaching the hanger to a prescribed suspending place.

When clothing, such as a shirt, trousers, and a skirt, is suspended on the hanger, the collar part of the shirt or the inside portion of the waist part of the skirt is engaged with the hanger body, and the clothing is attached to the suspending place via the first magnet. At this time, it is preferable that the hanger is attached via the first magnet to the suspending place, with the first magnet applied to the inside of the upper back body of the shirt or to the inside of the waist part of the trousers or skirt. As a result, the clothing is hung up over the hanger and at the same time, is suspended from the hanger in a state in which the upper back plate or waist part is clamped between the first magnet and the suspending place. Since the first magnet is attached in a projecting manner to one side surface of the hanger body, a gap is formed between the hanger body and the clothing to ensure ventilation. Another gap is also left between the hanger body and the suspending place, so that the thick portion or portions including seams, collars and pockets, between the hanger body and the suspending place, or thick portion or portions are formed when parts of the clothing are overlapped, can be accommodated in the gaps. Therefore, an attraction state of the magnet to the suspending place can be secured, and a situation hardly occurs in which the local thick parts of the clothing push the hanger body itself up to cause the magnet to float, resulting in detachment of the hanger from the suspending place.

In the hanger, the hanger body may be in a plate shape with a substantially circular outer configuration.

According to this hanger, since the hanger body has the substantially circular outer configuration, the inside of the collar of a shirt or of the waist part of a skirt or trousers can be hung up over the hanger body in the circular shape even where the hanger is attached to the suspending place regardless of the direction. That is, the hanger body has no directionality due to the substantially circular outer configuration, resulting in enabling clothing to be hung up over the hanger body irrespective of the direction in which the hanger is suspended, thereby preventing the clothing from slipping or falling off due to an inclination of the hanger body or preventing a situation where the clothing cannot be hung up from occurring. Since it is unnecessary to confirm the vertical direction of the hanger and pay attention to the inclination of the hanger when suspending the hanger, cumbersomeness of suspension can be diminished. The substantially circular configuration includes a disk shape, a cylindrical shape, a polygonal shape having more corners to resemble a circle in appearance, and a polygonal shape with the corners rounded. In addition, since the first magnet is attached to one surface of the hanger body in a projecting manner, where the first magnet is arranged at a center or at a prescribed position of the hanger body, the hanger can be easily detached from the suspending place because the hanger body is inclined due to the principle of levers (i.e., leverage) with the first magnet as a fulcrum to separate part of the first magnet from the suspending place when pushing the circumference of the hanger body toward the suspending place The hanger may be in a state in which the first magnet is solely attached to the plate shaped hanger body at a substantially central position.

According to this hanger, since the first magnet is solely attached to the rear side of the hanger body at the substantially central position, pushing any position of the hanger body enables the hanger body to be inclined due to the principle of levers insofar as the position is away from the first magnet, thereby separating part of the first magnet from the suspending place, and thereby detaching the hanger from the suspending place easily. As the position at which the portion of the hanger body is pushed is farther from the first magnet, the hanger body can be inclined with a smaller force, and therefore, the position is desirably at the circumferential end of the hanger body.

In this hanger, the hanger body may be formed with a vent extending in its thickness direction.

According to this hanger, since the hanger body is formed with a vent extending in the thickness direction of the hanger body, the air inside the clothing flows via the vent to ensure air ventilation to the clothing. Therefore, the clothing is amenable to drying, and the inside of the clothing is prevented from being filled with odor.

With this hanger, the hanger body can have a handle part projecting outward from the front surface of the hanger body to be grasped.

According to this hanger, since the handle projecting from the front surface of the hanger body can be grasped, clothing can be hung up over the hanger body while the handle is grasped. It is also possible to attach and detach the hanger to and from the suspending place by grasping the handle. Furthermore, even where the first magnet has a strong magnetic force, the hanger can be detached from the suspending place by grasping the handle.

The invention further provides a hanger having an attaching member for assisting the hanger to be attached to the suspending place. The attaching member includes a second magnet attracting and attached from the first magnet of the hanger, and an attaching means for attaching the hanger to the suspending place. The hanger is attached to the prescribed suspending place via the attaching member where attached via the attaching means, and the first magnet of the hanger is attracted by the second magnet. As the attaching means for the attaching member, another magnet attached to the back surface of the attaching member to render the magnet attracted to a suspending place can be used. An adhesive sheet, such as a double-sided tape, a screw, a nail, and the like may be used as an attaching means. In such a case, the hanger can be attached to an arbitrary suspending place on which a magnet is not attracted, such as a glass window, a wooden wall, or the like.

According to this hanger, where the attaching member is attached in advance to the suspending place via the attaching means, the first magnet of the hanger body is attracted to the second magnet of the attaching member. Where the attaching member is used, the hanger is attached with a stronger attraction force in comparison with where the attaching member is not used, because the hanger is attached to the suspending place as the first magnet of the hanger body and the second magnet of the attaching member are attracted to each other. That is, where the hanger is attached directly to the suspending place, the attraction force may not be enough because only the first magnet is attracted to the suspending place, so that the hanger may be detached from the suspending place or may slip off or fall off from the suspending place. To the contrary, with the hanger, since the magnets are attracted to each other, the hanger and the attaching member are firmly attached to each other, so that the hanger is hardly detached and hardly slips off or falls off. Moreover, a gap is formed by the thickness of the attaching member between the clothing and the suspending place, thereby improving air ventilation The attaching member may be provided with a projection projecting toward the hanger body at a position lower than the first magnet where the hanger is attached to the attaching member.

Because the projection is formed as projecting toward a side of the hanger body at a position lower than the first magnet when the hanger is attached to the attaching member, the clothing is hooked up over the projection when the hanger on which the clothing is engaged is attached to the attaching member. Therefore, since the clothing is hung up not only over the hanger but also over the attaching member, the weight of the clothing is dispersed to the hanger as well as the attaching member, so that the hanger is hardly detached from, or slips and falls off from, the suspending place. In a case where a penlight or the like is inserted into a pocket of the clothing so as to make the clothing too heavy to keep the hanger at the surface of the attaching member, the projection can serve as a stopper to prevent the hanger from further slipping off the attaching member. The projection can be partly disposed at a position lower than the first magnet of the hanger body. If projections are disposed along the outer periphery of the attaching member so as to surround the first magnet of the hanger body, one of the protuberances is always disposed at a position lower than the first magnet even when the attaching member is attached to the suspending place in any direction. Therefore, this is desirable from the standpoint of convenience.

The present invention further provides a method of suspending clothing in use of the hanger of the invention, including the steps of hanging up the clothing over the hanger body, and attaching the hanger to the suspending place via the magnet to interpose the clothing between the first magnet and the suspending place.

When clothing such as a shirt, trousers, or a skirt is hung up over the hanger for use, the hanger is attached to the suspending place via the first magnet after the collar portion of a shirt or waist portion of a skirt is engaged with the hanger body. At that time, the hanger is attached to the suspending place via the first magnet in applying the first magnet to the inside of the back portion of the shirt or the inside of the waist of the trousers or skirt. Then, the clothing is hung up on the hanger body, and the upper portion of the back portion or the waist portion is disposed and supported between the magnet and the suspending place, and the clothing is hung up on the hanger in a stable state.

The suspending method of the clothing is done, when using the hanger having the attaching member, hanging the clothing on the hanger body, and attaching the hanger to the prescribed suspending place via the attaching means of the attaching member as the clothing is provided between the first magnet of the hanger and the second magnet of the attaching member.

With this method, the attaching member is attached to the suspending place via the attaching means in advance, and the first magnet of the hanger is attracted to the second magnet. When this attaching member is used, the hanger can be attached to the suspending place with a stronger attraction force in comparison with a case where the hanger is attached to the suspending place without the use of the attaching member. That is, where the hanger is attached directly to the suspending place, attraction force may not be enough because only the first magnet is attracted to the suspending place, so that the hanger may be detached from the suspending place or may slip off or fall off from the suspending place. When the attaching member is used, however, since the magnets are attracted to each other, the hanger and the attaching member are firmly attached to each other, so that the hanger is hardly detached and hardly slips off or falls off. Moreover, a gap is formed by the thickness of the attaching member between the clothing and the suspending place, thereby improving air ventilation Other objects and features of the invention will become apparent from the specific description based on the attached drawings.

BRIEF DESCRIPTION OF THE DRAWINGS

FIG. 5(*b*) is a referential perspective view showing the state of use of the hanger of the first embodiment.

FIG. 7(*b*) is a front view showing still another example of the shape of a hanger body according to the present invention.

FIG. 7(*c*) is a front view showing yet another example of the shape of a hanger body according to the present invention.

FIG. 7(*d*) is a front view showing a further example of the shape of a hanger body according to the present invention.

FIG. 8(*b*) is a front view showing still another example of vents of the hanger according to the present invention.

DESCRIPTION OF THE PREFERRED EMBODIMENT

Hereinafter, the first embodiment of the invention is described with reference with the attached drawings. It is to be noted that in this specification, the example of clothing is an overall frequently worn at hospitals and laboratories, but the clothing includes not only such an overall but also jackets and trousers of working wear, shirts, suits, sweaters, pants, skirts, etc.

Figure 1:
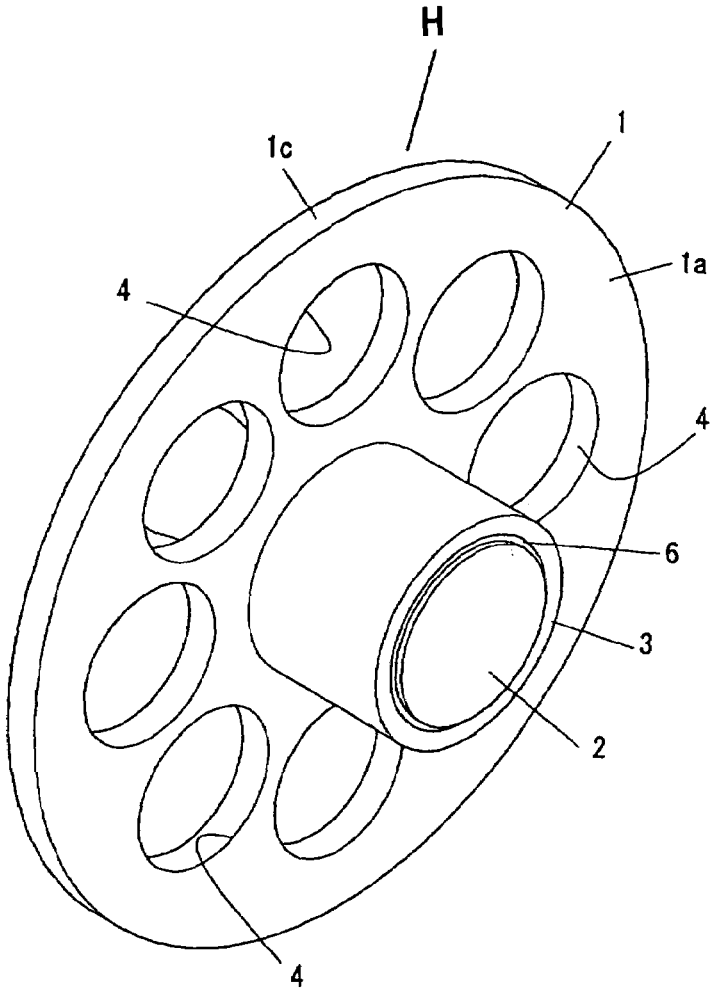
FIG. 1 is a perspective view showing a hanger of the first embodiment according to the present invention.
Figure 2:
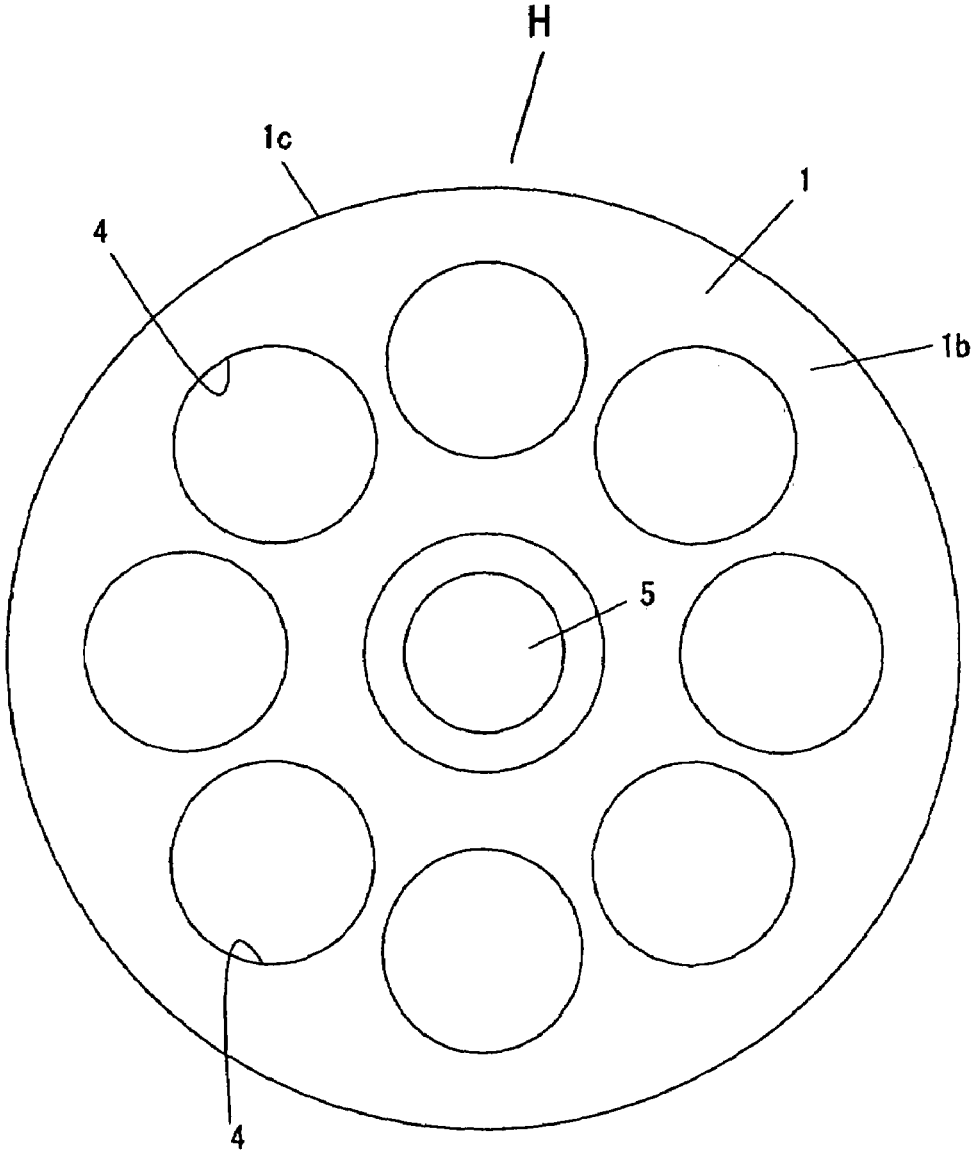
FIG. 2 is a front view showing the hanger of the first embodiment.
Figure 3:
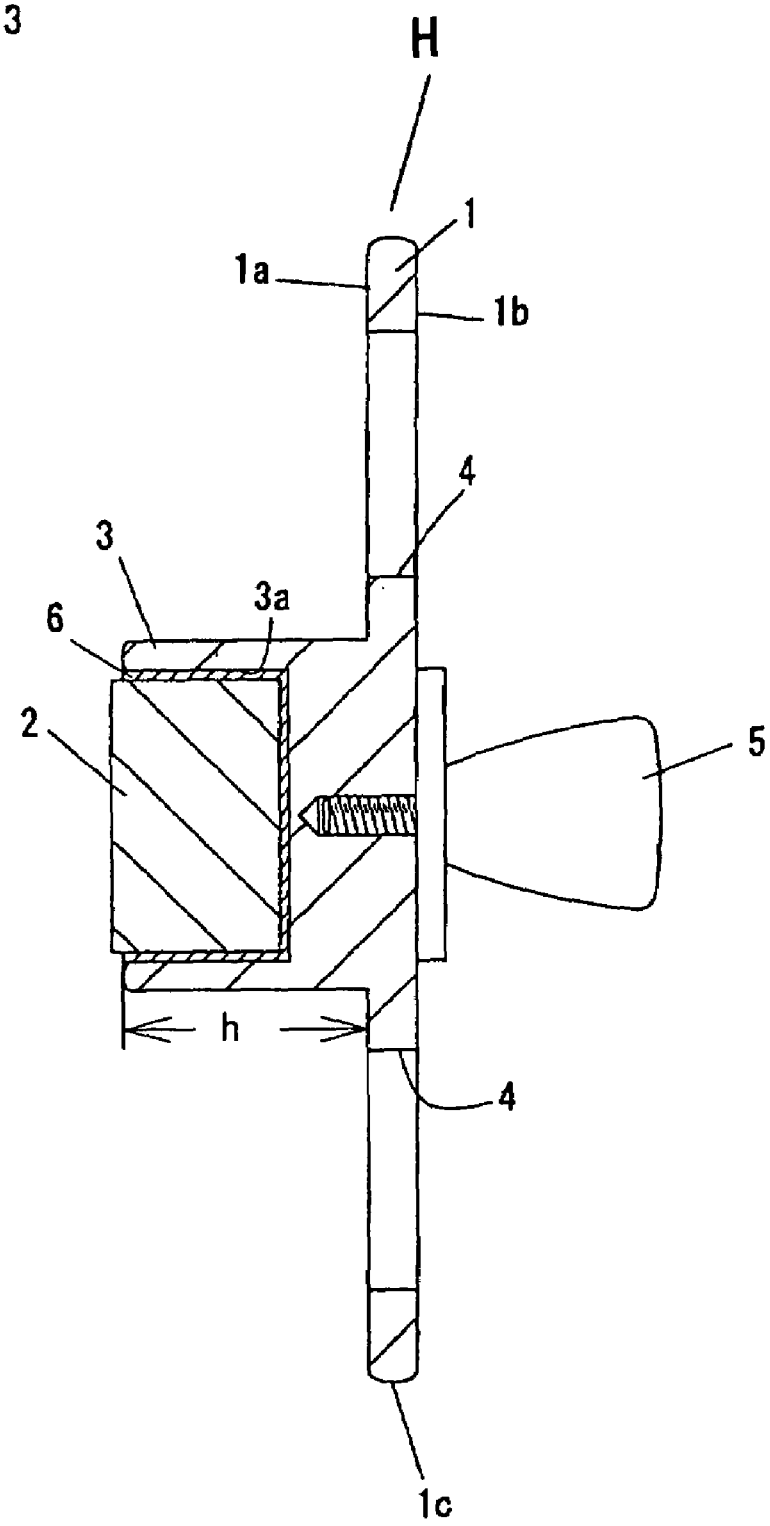
FIG. 3 is a cross section showing the hanger of the first embodiment.
Figure 4:
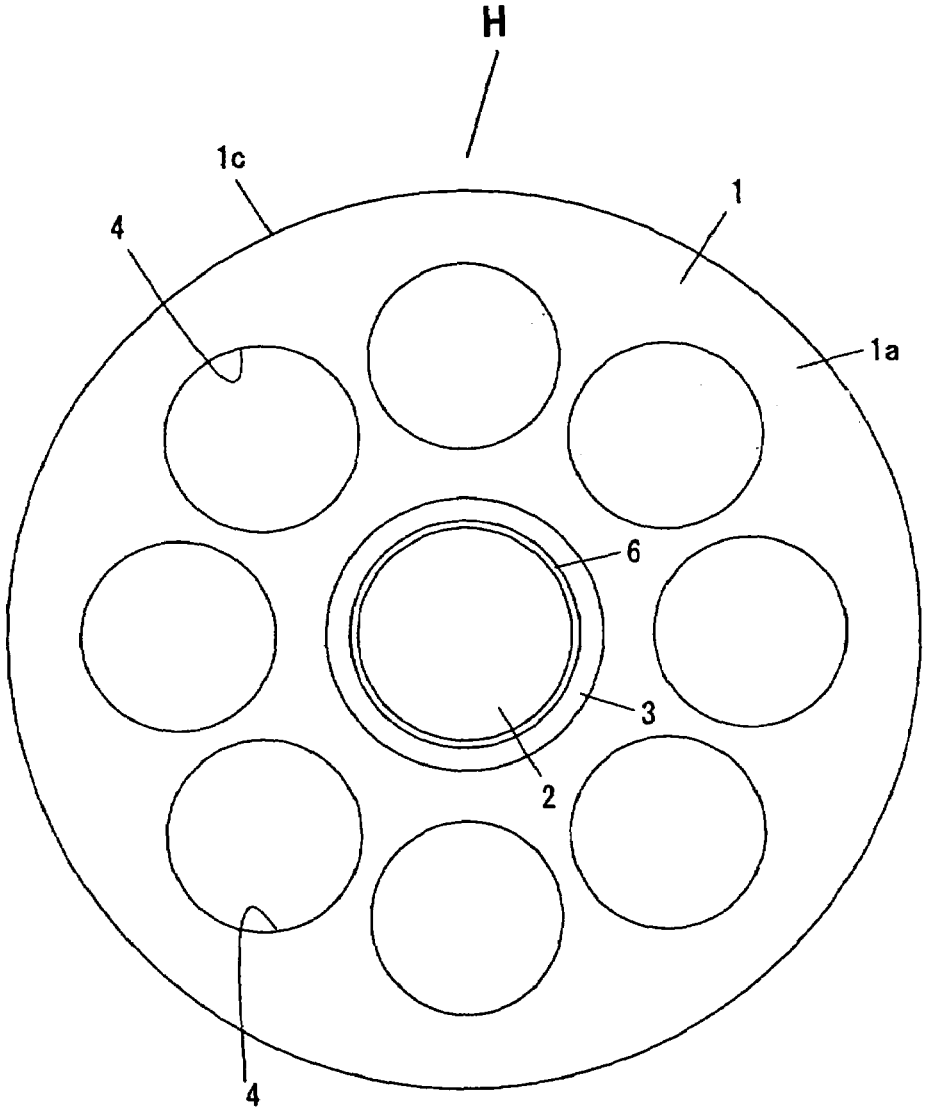
FIG. 4 is a rear view showing the hanger of the first embodiment.

FIG. 1 is a perspective view showing a hanger H according to a first embodiment of the invention. FIG. 2 is a front view thereof; FIG. 3 is a cross section thereof; FIG. 4 is a rear view; and FIGS. 5(*a*) and 5(*b*) are a cross section and a referential perspective view showing a used state thereof. The hanger H of this embodiment is attached via a magnet 2 to a suspending place W such as a side surface of a steel locker or an iron plate wall surface and is used on which clothing C is hung up. The hanger H includes a hanger body 1 on which clothing is hung, a first magnet 2 arranged at a rear side (second side) 1*a* of the hanger body 1, and a handle 5 projecting from a front side (first side) 1*b* of the hanger body 1.

The hanger body 1 has a disc shape and is made of a transparent plastic material. As a material for the hanger body 1, synthetic resins such as plastics, woods, metals, and other materials can be used. The size of the hanger body 1 is about 12 cm in diameter, but can be more than that and less than that. Further, it is desirable to be in a size such that the clothing C is extended so as to prevent the clothing C from being subjected to wrinkles to some extent when the clothing C is hung up on the hanger body 1. To enlarge the hanger body 1, the clothing C can be hung in a more extended state, thereby reducing wrinkles on the clothing C. The hanger body 1 has not only a disc shape, but also a cylindrical shape having a thickness to some extent, an oval shape, or an inversed V shape or substantially equilateral triangle similar to ordinary hangers. To intensely prevent the clothing from being subjected to wrinkles, the hanger body 1 is desirably in the shape of an inversed V shape or substantially equilateral triangle similar to ordinary hangers. On the other hand, when convenience at the time of attachment such that the attachment can be made without paying attention to the vertical direction of the hanger or the inclination of the attached state, and functionality such that the clothing does not slip down even where attached in any direction, are intensely considered, the hanger body 1 preferably has a substantially circular outer configuration. Such a substantially circular outer configuration includes a disc shape, a cylindrical shape, a substantially circular outer configuration in which the number of corners of a polygon is increased likewise a plate body such as a hexagonal shape, and an octagonal shape, and a substantially circular outer configuration in which corners of a polygon are rounded likewise a plate body such as a hexagonal shape, and an octagonal shape.

A projection 3 in a cylindrical shape is formed on a rear side (second side) 1*a* of the hanger body 1. The projection 3 is formed by projecting a center portion of the rear side 1*a* of the hanger body 1, and is made in a united body (one-piece) with the hanger body 1. The projection 3 has a diameter of about 3.5 cm, and a height h of about 2.5 cm, and a recess 3*a* for accommodating the first magnet 2 is formed inside so as to correspond to the shape of the first magnet 2 and more specifically is formed with a depth around two thirds of the depth of projection 3. It is to be noted that the projection 3 is not limited to the cylindrical shape, a rectangular pillar shape or other shapes, but it is preferable to correspond to the shape of the first magnet 1 because the first magnet 1 is fitted therein. The projection 3 can also be formed as a separate member without projecting the hanger body 1. As shown with a hanger Ha in FIG. 6, the first magnet 2 can also be directly attached to the rear side 1*a* with adhesive or the like without forming any projection 3.

Figure 6:
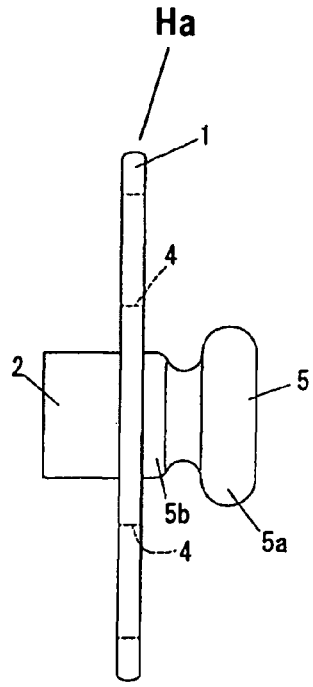
FIG. 6 is a cross section showing another example of a first magnet and another example of a grip portion of the hanger according to the present invention.
Figure 7:
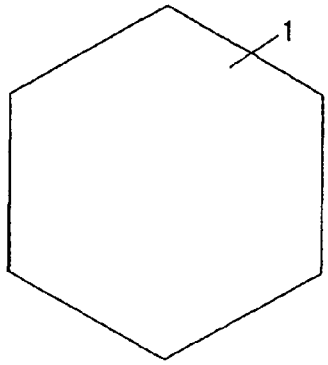
FIG. 7(*a*) is a front view showing another example of the shape of a hanger body according to the present invention.
Figure 7:
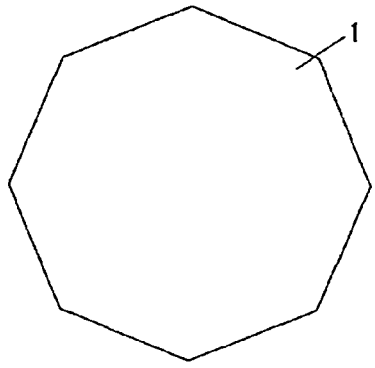
Figure 7:
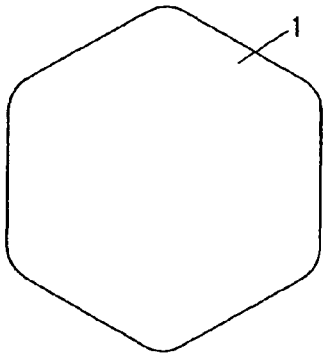
Figure 7:
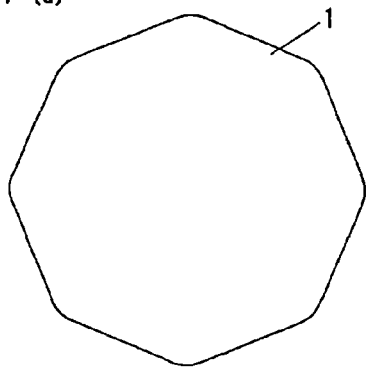

The first magnet 2 has a cylindrical shape, having a magnetic pole on each end. The first magnet 2 is arranged solely at a center of the rear side 1*a* via the projection 3 formed on the rear side 1*a* of the hanger body 1. More specifically, the first magnet 2 is secured with adhesive upon being fitted in the recess 3*a* inside the projection 3 formed on the rear side of the hanger body 1. It is to be noted that although a metal member 6 is shown between the first magnet 2 and the recess 3*a*, a metal member need not be placed there. The metal member 6 plays a roll to reinforce the projection made of a plastic material as well as to enhance the magnetic force. That is, the first magnet 2 is in a state projecting by a portion of height h of the projection from the rear side 1*a* of the hanger body 1 (FIG. 3). The projecting height of the first magnet 2 (or height of the projection 3) h is about 2.5 cm, and the height can be more or less, but it is preferable to set the height so as to ensure ventilation when the clothing C is hung up on the hanger body 1 and so as not to render an attaching state unstable due to an overly high height. The shape of the first magnet 2 can be in a rectangular pillar shape, a sheet shape, or other shapes. The formed position can be other positions such as outer peripheral ends or the like, and the number can be two or more. It is, however, necessary to design the shape, position, and number (quantity) as to make the hanger body 1 stable when the hanger H is attached to a suspending place W. In consideration of convenience for taking the hanger H out, it is desirable to set the shape, position, and number so as to be able to make the hanger body 1 inclined about the first magnet 2 acting as a fulcrum on the basis of the principle of levers. The first magnet 2 can be stripped as shown in FIG. 6, but it is preferable to design the first magnet 2 whose side surface is covered with a resin such as a plastic as in this embodiment, to design the first magnet 2 with not only the side surface but also the rear side (a surface attaching to the suspending place W) covered with a resin such as a plastic, and to design the first magnet 2 covered with a soft material such a cloth or the like, so that the first magnet 2 comes in contact with the clothing C via the resin or the clothing, because the clothing C can avoid damages. The magnet is preferably, e.g., an alnico magnet, an Fe—Cr—Co system magnet, a ferrite magnet, or a rare earth group system magnet such as Sm—Co system magnet, Nd—Fe—B system magnet, etc. It is desired that the diameters of the first magnet 2 and the projection 3 are in a size such that the hanger body 1 protrudes by a certain width from the first magnet 2 and the projection 3 so as to effectuate the principle of levers when the hanger body 1 is removed by rendering the first magnet 2 as a fulcrum.

Figure 8:
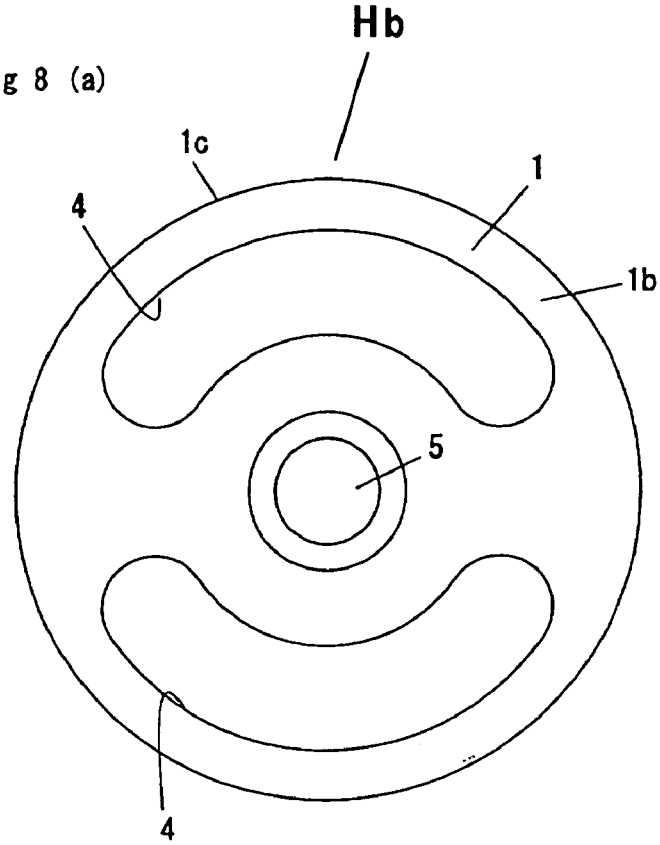
FIG. 8(*a*) is a front view showing another example of vents of the hanger according to the present invention.
Figure 8:
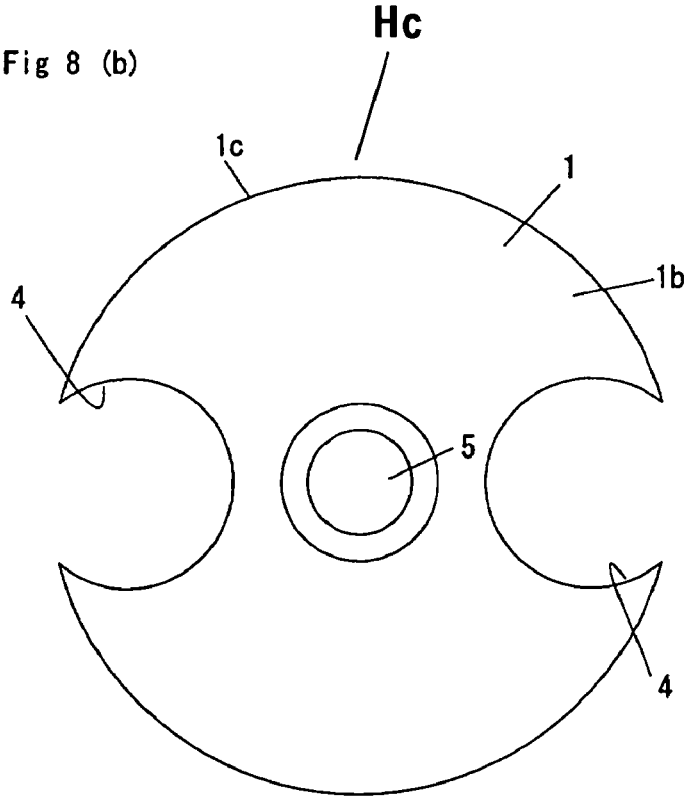

The hanger body 1 is formed with plural vents 4 extending in a thickness direction of the disc. Each vent 4 is circular, and eight vents are formed along the outer periphery of the hanger body 1 as aligned in a circle as a whole. The shape of each vent 4 can be not only in a circle but also in a rectangle or other shapes, and the size and the number (quantity) are arbitrary. From a viewpoint to ensure ventilation, it is desired to form many large vents 4, but the hanger body 1 is required to have a strength of a degree that the hanger body 1 is not cracked or broken even when the clothing C is hung over. For example, as shown with a hanger Hb in FIG. 8(*a*), two vents 4 shaped as an oval curved along the outer peripheral edge of the hanger body 1 can be provided. As shown with a hanger Hc in FIG. 8(*b*), two annular vents 4 are formed at positions reaching the outer peripheral edge 1*c* of the hanger body 1, and a part of the outer peripheral edge 1*c* of the hanger body 1 can be in a cutout state. The hanger body 1 can be formed with a metal member in a mesh form, thereby widening the area occupied by the vents 4 to raise the ventilation property.

Figure 9:
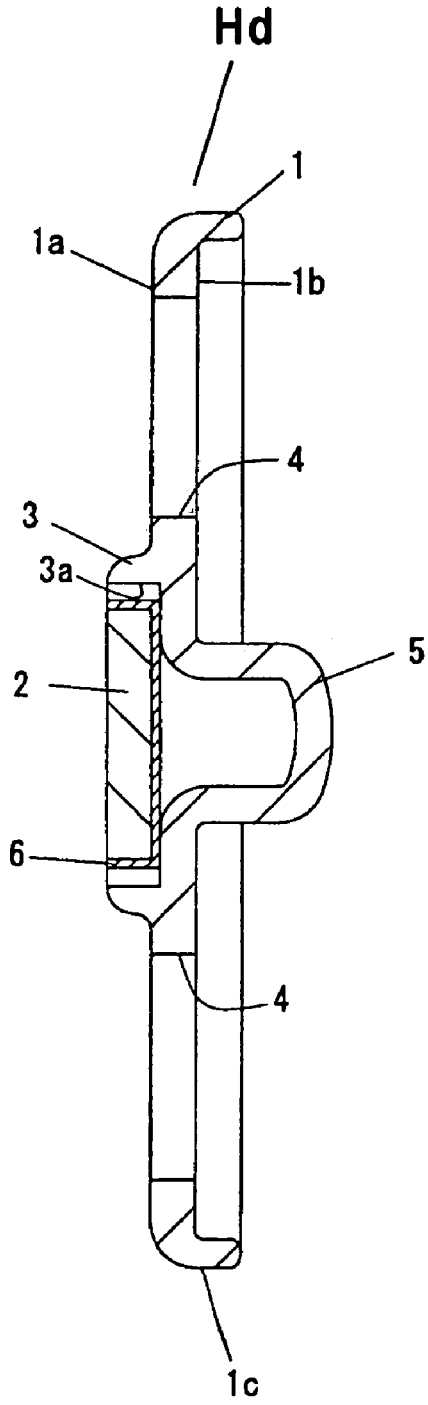
FIG. 9 is a cross section showing still another example of the grip portion of the hanger according to the present invention.
Figure 10:
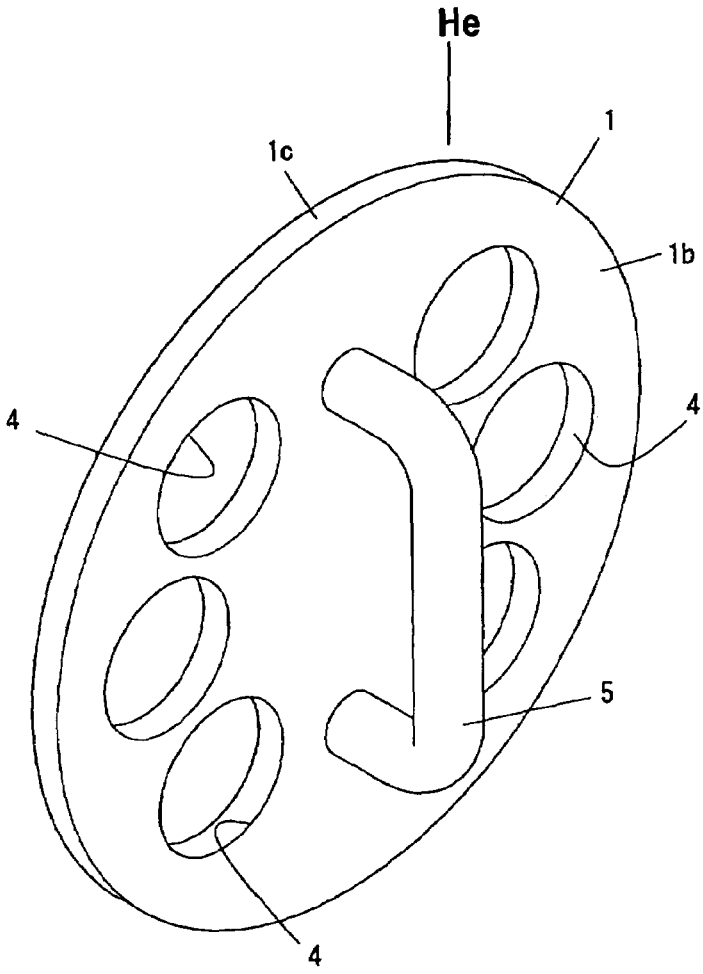
FIG. 10 is a perspective view showing yet another example of the grip portion of the hanger according to the present invention.

The handle 5 is bolted at the center of the front side 1*b* of the hanger body 1 to utilize the thickness of the projection 3 (FIG. 3). The handle 5 is grasped when the clothing C is hung up on the hanger body 1, and when the hanger H is attached to and detached from the suspending place W. The handle 5 has a cylindrical shape becoming gradually narrower closer to the rear side (or hanger body side) so as to be easily grasped. The handle 5 may be one easily grasped, and can be, e.g., in the shape of a door knob in which a portion 5*a* to be grasped has a large diameter and a portion 5*b* coupled to the hanger body 1 has a small diameter (hanger Ha in FIG. 6), in a shape in which a part of the hanger body 1 is molded so as to project toward the front side 1*b* (hanger Hd in FIG. 9), and in a shape in which a fitting or the like extending in a rectangular U shape is attached (hanger He in FIG. 10). The position at which the handle 5 is attached can be anywhere, but it is desirable to position the handle 5 near a position opposing the first magnet 2 so that the hanger body 1 can be easily attached to and detached from the suspending place W. The handle 5 can be adhered to the front side of the hanger body 1 with an adhesive (hanger Ha in FIG. 6). Alternatively, the handle 5 may not be formed, and in such a situation, the hanger body 1 can be grasped, or the hanger is handled by inserting a finger or fingers in the vent 4.

Figure 5:
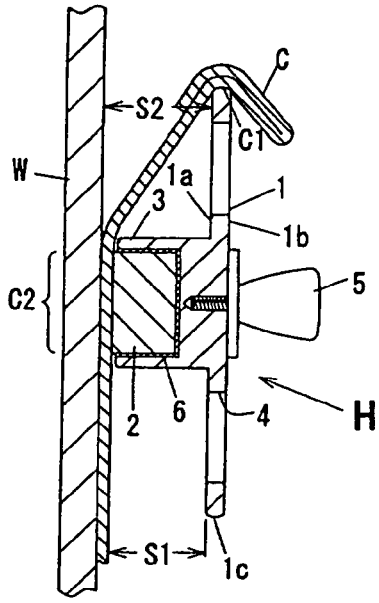
FIG. 5(*a*) is a cross section showing the state of use of the hanger of the first embodiment.
Figure 5:
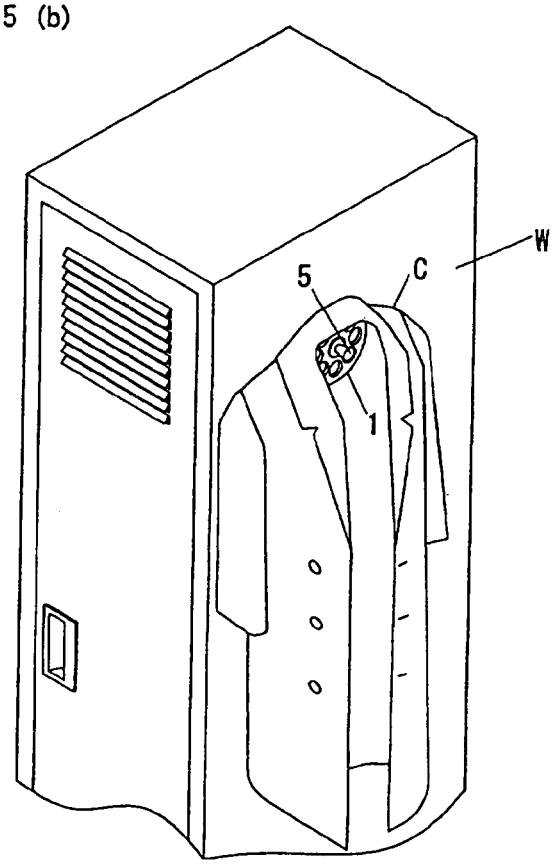

To hang the clothing C on the hanger H, in illustrating an example in which an overall is used as the clothing C, first of all, the handle 5 is grasped to hold the hanger H, and a nape portion C1 of the clothing C is engaged with the hanger body 1 after the hanger body 1 is placed inside the clothing C in applying the first magnet 2 to the inner side of an upper portion C2 of a back side of the clothing C. Subsequently, the first magnet 2 is made to attract the suspending place W such as a side wall of a steel locker or the like, thereby attaching the hanger body 1 to the suspending place W. The clothing C is engaged with the hanger body 1, and the back side upper portion C2 is clamped between the suspending place W and the first magnet 2 and is hung up (FIG. 5). A portion engaging the hanger body 1 is not limited to the inner side of the nape portion of a shirt or waist portion of a skirt, and any place other than the back side of the shirt (notwithstanding the inner side or the outer side) and the waist portion of a skirt can be engaged in utilizing the circular shape in which any direction can be used. That is, the clothing can be engaged without specially determining which portion is to be engaged.

The first magnet 2 projects from the rear side 1*a* of the hanger body 1 by a prescribed height h (namely, the height h of the projection). Therefore, a gap S1 is created between the hanger body 1 and the clothing C to ensure ventilation. Because the vents 4 are formed at the hanger body 1 and extend in the thickness direction, the air inside the clothing C flows via the vents 4. Because a gap S2 is formed between the hanger body 1 and the suspending place W, the gap S2 can contain a thick portion where such a thick portion of the clothing C is provided between the hanger body 1 and the suspending place W or where a thick portion is formed by an overlapped clothing C. Accordingly, a problem hardly occurs in which the hanger body 1 is pushed up by a locally thick portion of the clothing to float the first magnet 2 and to detach the hanger H from the suspending place W. Because the hanger body 1 is circular with a certain size, the clothing may be slightly subject to wrinkles in comparison with engagements in a hook shape, thereby preventing the engaged nape portion C1 from being elongated or broken. Since the hanger body 1 is in a disc shape, the clothing C can be engaged to the hanger body 1 in the disc shape even where the hanger body 1 is attached to the suspending place W in any direction. That is, the hanger body 1 has no directionality because the outer configuration is in the disc shape. Therefore, the hanger H can be attached easily with no need to make the attachment with care for the vertical orientation or inclination of the hanger body 1 while the clothing C can be engaged even where the hanger body 1 is attached in any direction. Even if the hanger H is attached randomly, the clothing C may not slide down from the inclination of the hanger body 1, so that a problem that the clothing C is unable to be hung may not occur.

When the clothing C is disengaged from the hanger H, the clothing C is disengaged from the hanger body 1 after the hanger H is removed from the suspending place W. When the hanger H is detached from the suspending place W at that time, a spot on the outer peripheral edge 1*c* of the hanger body 1 is pushed by a finger so as to be pushed down to the suspending place W, or a spot of the outer peripheral edge 1*c* is manipulated to be inclined by holding the handle 5. The hanger body 1 is inclined around the first magnet 2 as a fulcrum, thereby rendering the first magnet 2 partly separated from the suspending place W (the principle of levers). Under this situation, the handle 5 is grasped, and the hanger H is removed from the suspending place W. Because the hanger H is removed while the first magnet 2 is partly separated from the suspending place W, the hanger H can be easily detached from the suspending place W. Since the first magnet 2 is solely arranged at a center of the rear side of the hanger body 1 in the disc shape, the principle of levers can be used in pushing anywhere as far as the pushing position is apart from the first magnet 2.

When the hanger H is used in a hospital or a construction site, the hanger H can be used by being attached to a side surface W of a steel locker or wall surface of an iron panel even where putting on and taking off of the clothing is repeated many times during use of the same overall or working clothing, or the like, so that those clothes can be hung separated from other clothes and it is sanitary. This also prevents desks and chairs from becoming dirty due to transfer of germs and dusts attached to the overalls or working clothes where such overalls or working clothes are left on the desks and chairs. This hanger makes it unnecessary to store the clothing inside the locker each time, even where the users frequently repeat putting on and taking off of the clothing, and allows the users to orderly place the hanger upon attaching it to the suspending place W such as a side surface of the steel locker. The hanger H can be attached in a random manner without concern about and down sides and the inclination of the hanger H because the hanger H has no directionality and is in the disc shape, thereby reducing labor at a time of containment and attachment. Although the overalls and working clothes are frequently subject to chemicals, water, and perspirations and get wet and odorized, such clothing can be readily dried and deodorized because the ventilation is ensured by the first magnet 2 projecting from the rear side 1*a* of the hanger body 1 and by the vents 4. Although the overall and working clothes frequently become heavier when a penlight or working instrument is placed in the pocket or the like and may be subject to wrinkles, the overalls and working clothes can be hung up by being widened to some extent since the hanger body 1 is in the disc shape with an area to some extent, so that wrinkles may be formed to a lesser extent than when the clothing is hung by a hook-shaped hanger. Although the strong first magnet 2 has to be used for the hanger H so that the hanger H does not drop off from the suspending place W even where the penlight or working instrument is placed inside to have the hanger heavier, such a strong magnet thus used can be removed easily due to the principle of levers.

Figure 11:
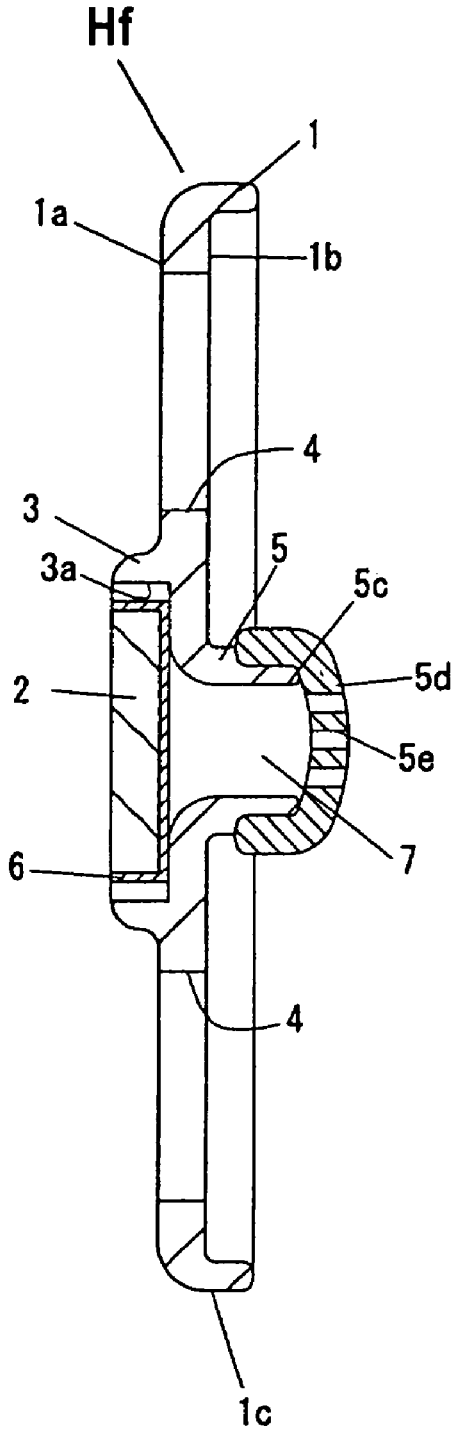
FIG. 11 is a cross section showing a modification of the hanger of the first embodiment.
Figure 12:
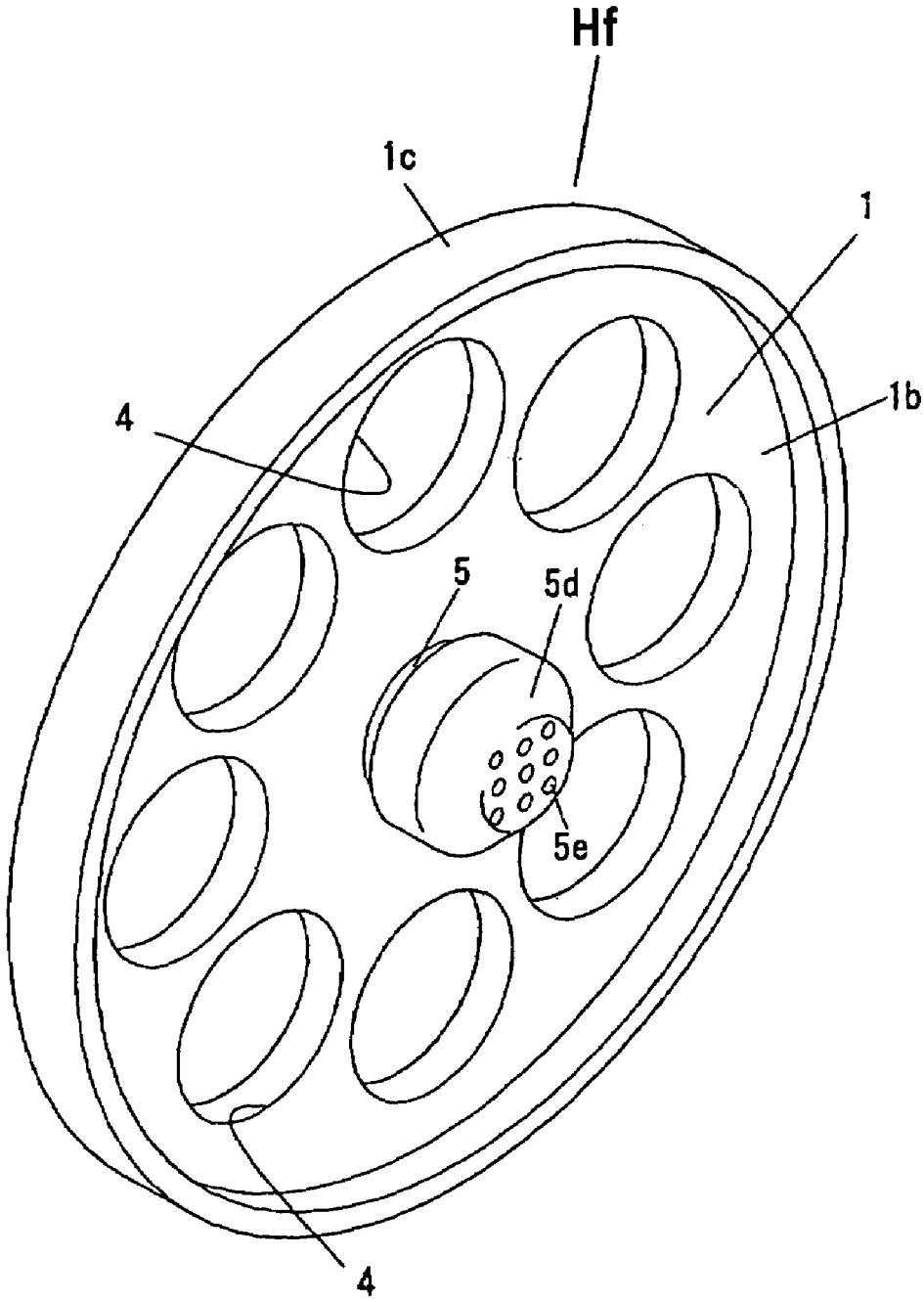
FIG. 12 is a perspective view showing the modification.

FIG. 11 is a cross section showing a hanger Hf as an application of the hanger H shown in the first embodiment; and FIG. 12 is a perspective view. The handle 5 of the hanger Hf is formed as projecting toward the front side 1*b* at a center of the hanger body 1. A space 7 is formed as coupled from a front end 5*c* of the handle 5 to the rear side 1*a* of the hanger body 1. A cap 5*d* is attached to the front end 5*c* of the handle 5, and the first magnet 2 and the metal member 6 are attached to the rear side 1*a* of the hanger body 1 to close the space 7. Fragrances and repellants can be contained in the space 7, and are supplied to the clothing C through holes 5*e* formed in the cap 5*d* and a gap formed between the metal member 6 and the hanger body 1. When the fragrances and repellants are contained in the space 7, the fragrances and repellants are placed in the space 7 upon opening the cap 5*d*. To supply a replacement, after the used fragrances and repellants are removed upon opening the cap 5*d*, new ones are loaded, and the cap 5*d* is shut again. The cap 5*d* also serves the role of the handle 5 as in a united body with the handle 5 attached to the front end 5*c* of the handle 5.

Figure 13:
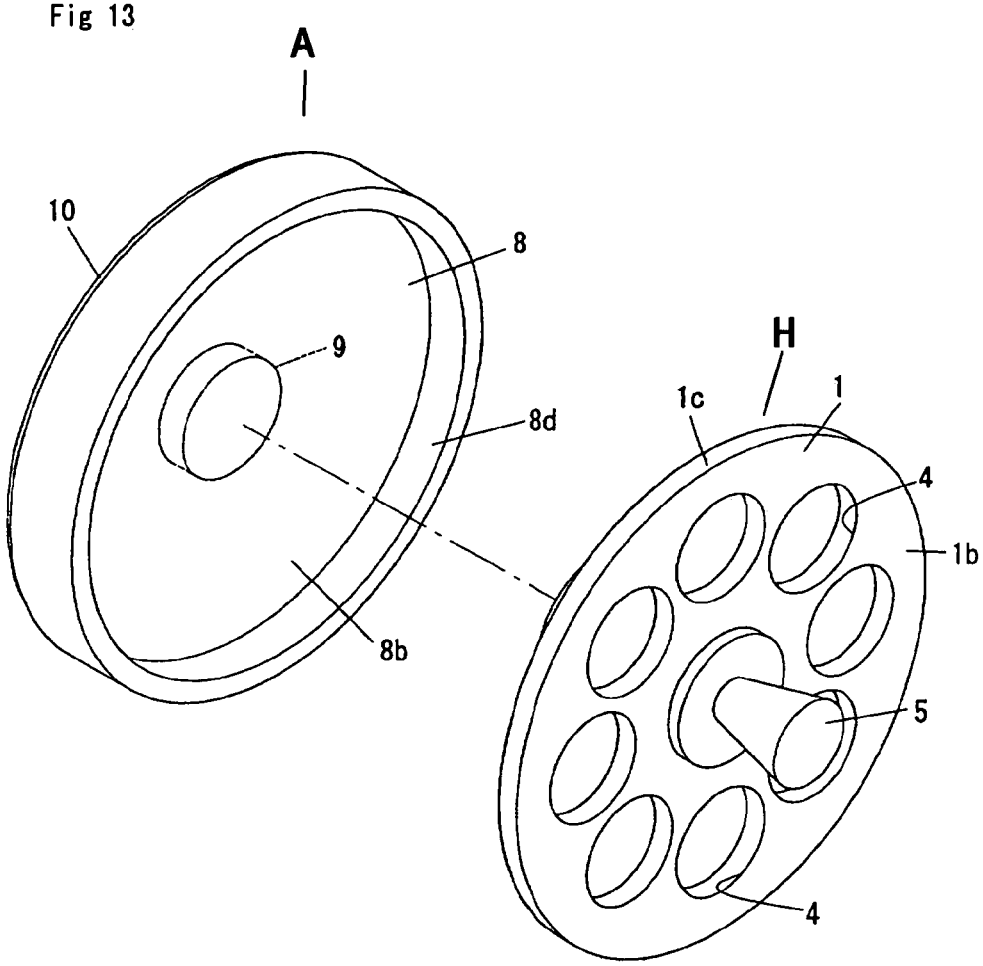
FIG. 13 is a perspective view showing a hanger with an attaching member of the second embodiment according to the present invention.
Figure 14:
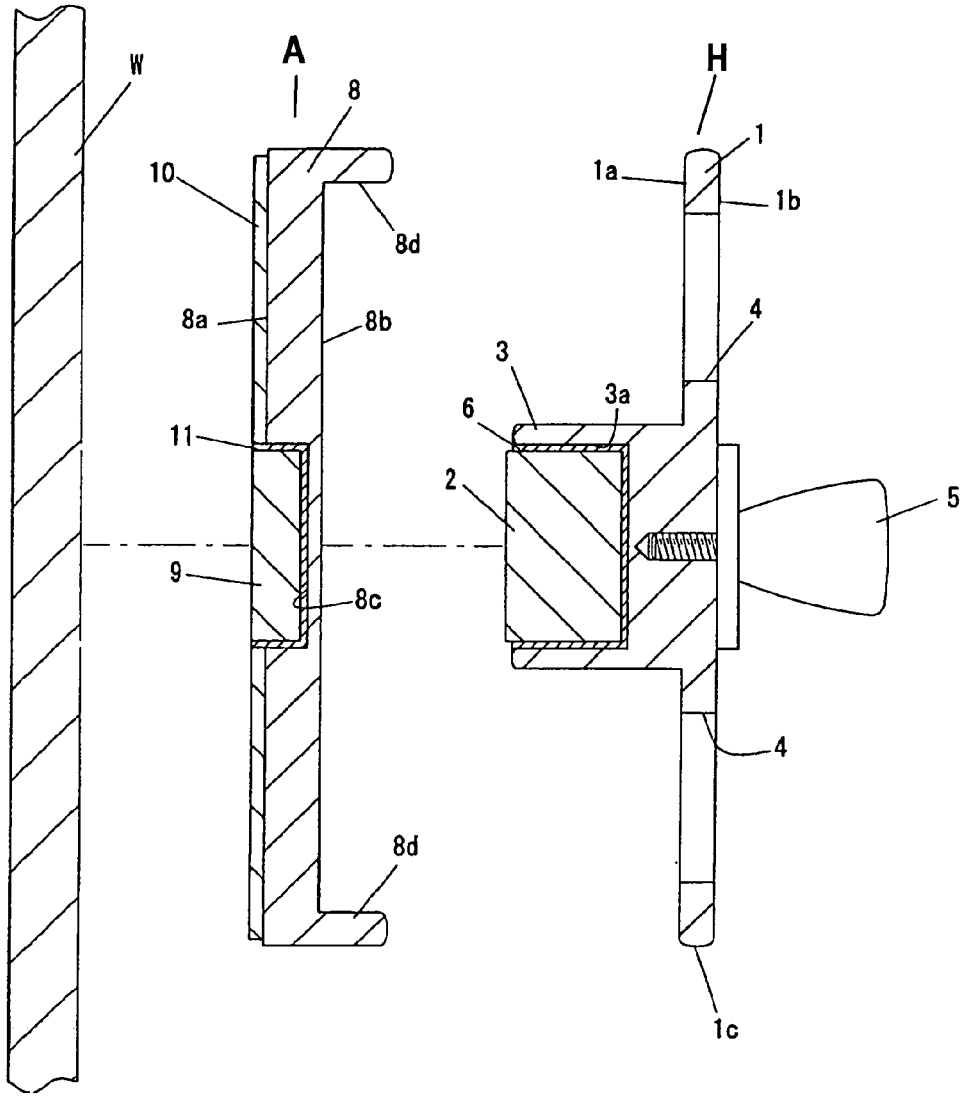
FIG. 14 is a cross section showing the hanger of the second embodiment.
Figure 15:
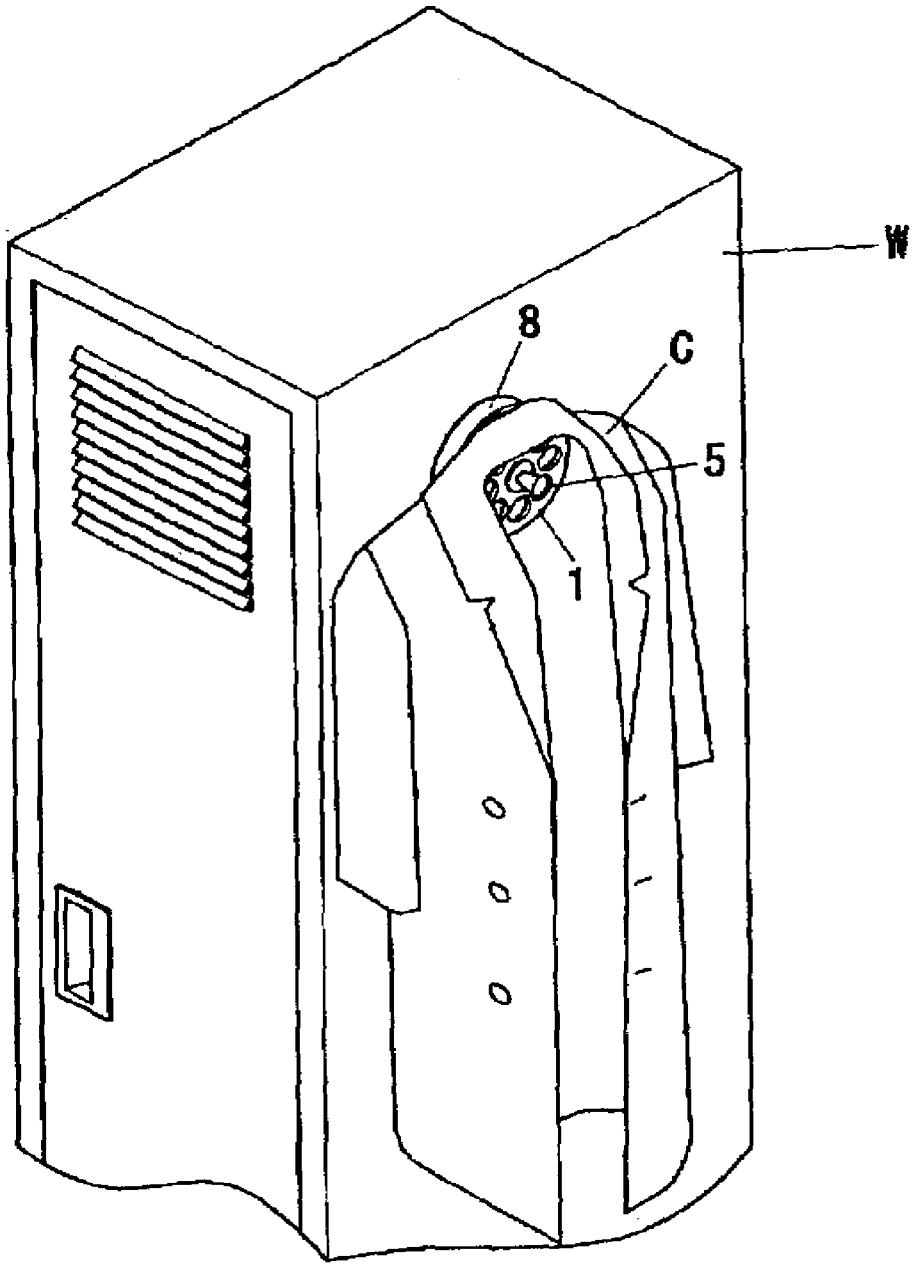
FIG. 15 is a perspective view showing the state of use of the hanger of the second embodiment.

FIG. 13 is a perspective view showing a hanger having an attaching member A as a second embodiment; FIG. 14 is a cross section thereof; and FIG. 15 is a perspective view showing a using state. The attaching member A of the embodiment is provided to assist with the attachment of the hanger H of the above first embodiment to the suspending place W and is used in combination with the hanger H. The attaching member A includes a substrate 8, a second magnet 9 at a center of the rear side 8*a* of the substrate 8 to attract and to be attracted by the first magnet 2 of the hanger H, and an attaching component 10 for attaching the attaching member A to the suspending place W.

The substrate 8 has a disc shape with substantially the same size as the hanger body 1 of the hanger 1 and is made of a plastic material. The substrate 8 can be in other shapes such as a plate body of a rectangular or triangular shape, and can be larger or smaller than the hanger body 1. A recess 8*c* is formed at a center portion of the rear side 8*a* of the attaching member A for fitting the second magnet 9.

Figure 16:
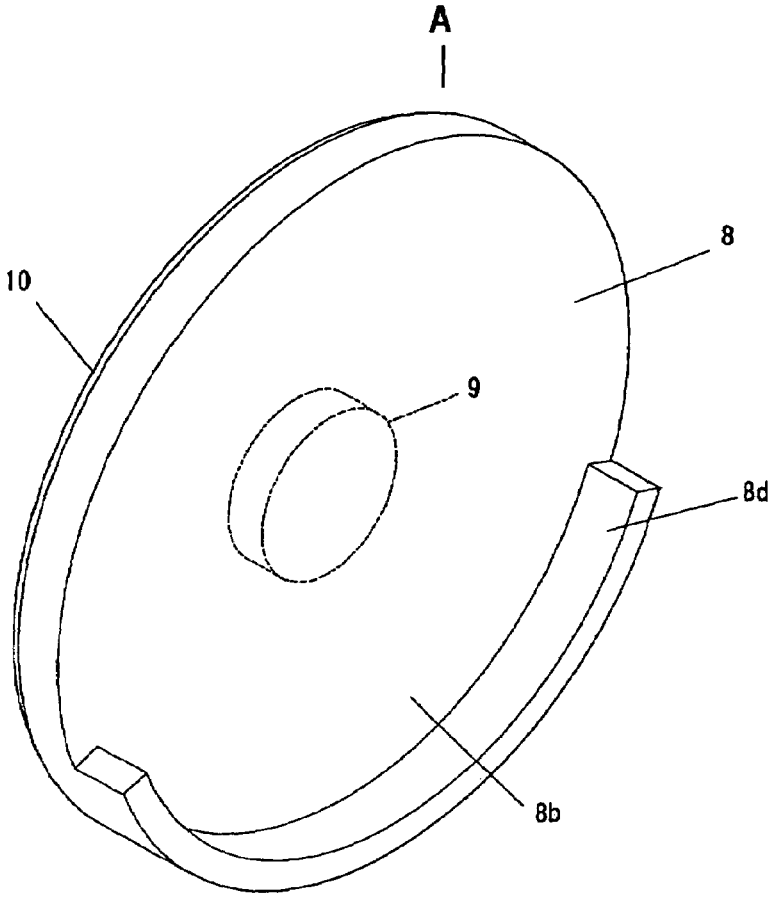
FIG. 16 is a perspective view showing another example of the attaching member according to the present invention.
Figure 17:
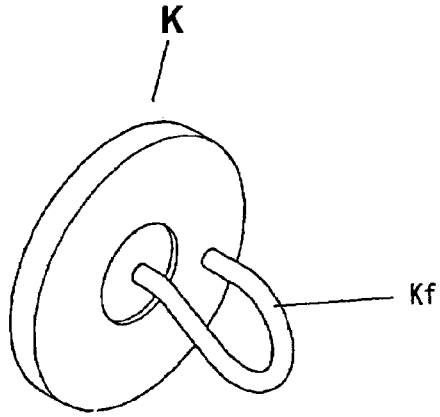
Fig 17 Prior art
FIG. 17 is a perspective view showing a prior art hooking implement with a magnet.

A peripheral projection 8*d* projecting toward the side of the hanger H is formed along the outer periphery at the outer peripheral edge of the substrate 8. The projection 8*d* of the substrate 8 has a constant width. The projection 8*d* is formed in a united body (one piece) with the substrate 8 by molding the substrate 8 so that the outer peripheral edge of the substrate 8 projects, but can be formed by attaching a separate member. The height of the projection 8*d* is such that the clothing C engages the projection 8*d* when the hanger H is attached in a state such that the clothing C is hung up over the hanger body 1, and a height of a degree so as not to contact the hanger body 1. More specifically, the height of the projection 8*d* is about 1 cm, but it can be more or less. The position at which the projection 8*d* is formed can be lower than that of the first magnet 2 of the hanger body 1 when the hanger H is attached to the attaching member A, and for example, as shown in FIG. 16, the projection can be placed partly at a position lower with respect to the first magnet 2. Formation of the projection 8*d* along the entire outer peripheral edge of the attaching member A as shown in FIG. 13 is preferable for convenience for the attachment of the attaching member, because the projection 8*d* is located at the lower position where the attaching member A is attached to the suspending place W in any direction. The front side 8*b* of the substrate 8 can be flat without forming any projection, but such projection is desirably formed to prevent the hanger from slipping.

The second magnet 9 has a cylindrical shape and has a magnetic pole on each side. The second magnet 9 is secured with adhesive as fitted in the recess 8*c* of the substrate 8 in a direction having magnetic property to attract and be attracted by the first magnet 2 arranged in the hanger body 1 when the hanger H is attached. The diameter of the second magnet 9 is substantially the same as the first magnet 2 of the hanger H, and the height of the second magnet does not create a step with the attaching means (magnet in a thin plate shape) as described below when secured as fitted in the recess 8*c*. Although the second magnet 9 is attached to the recess 8*c* formed at the rear side 8*a* of the substrate 8, the magnet can be attached upon forming a recess on the front side 8*b* of the substrate 8 and can be attached directly without forming any recess on the front side 8*b*. However, it is better to form the recess on the rear side 8*a* as in this embodiment. This is because the clothing C can be prevented from being torn by the magnet 9 since the clothing C is clamped via the front side 8*b* of the substrate 8 made of a plastic, and because it effectuates to assist the attaching component 10 in attaching the suspending place W at the rear side 8*a*. The size and shape of the second magnet 9 are arbitrary, and the second magnet 2 can be larger or smaller than the first magnet 2 of the hanger H. The attaching member A itself may be formed of a strong magnet in a sheet shape, which serves commonly as the second magnet 9 located at the center of the substrate 8 and the attaching means 10. In such a case, the magnets are attracted to each other and secured even where the hanger H is attached to any place of the attaching member A. It is to be noted that a metal member 11 for reinforcing the recess 8*c* made of plastic and enhancing magnetic force is provided between the second magnet 9 and the recess 8*c*, but it need not be provided.

The attaching component 10 is for attaching the attaching member A to the suspending place W, and in this embodiment, a magnet in a thin plate shape is used. The magnet as this attaching component 10 is disposed in a direction aligning the magnetic poles to the second magnet 9 at the center, and is adhered with adhesive to the entire rear surface 8*a* of the substrate 8, except the portion of the second magnet 9. The attaching component 10 can be anything to render the attaching member A attached to the suspending place W, and can be made by adhering a sticking sheet such as a double side tape on the rear side 8*a* of the substrate 8 or be so made that the substrate 8 is secured with nails, screws, or the like. Where the attaching component 10 is a magnet, the magnet can be easily attached to and detached from the side surface of steel lockers or walls of steel plates. When the attaching component 10 is a double side tape, screws, nails, or the like, the attaching member A can be attached to a place where a magnet is not attached, such as a glass window, a wooden wall, etc., so that the hanger H can be attached to such an arbitrary location.

The attaching member A is used in combination with the hanger H of the first embodiment. The attaching member A is attached in advance to the suspending place W by the attaching component 10. When the clothing C is hung up, the first magnet 2 of the hanger H is disposed to meet the center of the attaching member A after the clothing C is engaged over the hanger body 1 of the hanger H as described in the first embodiment. The first magnet 2 of the hanger H and the second magnet 9 at the center of the attaching member A then attract each other, so that the hanger H is attached to the suspending place W via the attaching member A. The clothing C is placed between the hanger H and the attaching member A, and is hung up so as to be clamped between the first magnet 2 of the hanger H and the second magnet 9 at the center of the attaching member A. A part of the clothing C is engaged with the projection 8*d*.

When the attaching member A is used, the hanger H is attached to the suspending place W. The first magnet 2 of the hanger H attracts and is attracted by the second magnet 9 of the attaching member A, so that the hanger H can be attached with stronger attraction force to the suspending place W in comparison with a case in which the hanger H is attached directly to the suspending place W (FIG. 15). Therefore, where the clothing C is heavy in the case of suits, coats, etc., or where the clothing C is heavy because a penlight or working instrument is placed in the pocket of the clothing C such as overalls or working clothes, the hanger H is hardly detached or slipped off from the suspending place W. When double side tapes, screws, nails, etc. are used as the attaching means 10, the hanger H can be attached to an arbitrary place to which any magnet does not adhere such as a glass window, a wooden wall, etc. Since a part of the clothing 8 is engaged with the projection 8*d*, the clothing C is not only engaged with the hanger H but also engaged with the attaching member A, so that the weight of the clothing C is dispersed to the hanger H and the attaching member A, thereby further preventing the hanger H from being detached or slipped off. Moreover, even where the hanger H slides down from the front side 8*b* of the attaching member A due to the overly heavy weight of the clothing C, the projection 8*d* of the substrate 8 operates as a stopper, thereby preventing the hanger from sliding more by mutual attraction between the sheet magnet acting as the attaching component 10 and the first magnet 2 of the hanger H. Because a gap is created between the suspending place W and the clothing C from the thickness of the attaching member A, ventilation is improved. Even where the clothing C is covered with perspiration, dust, chemicals, germs, etc., the hanger prevents the perspiration, germs, etc. from transferring and making the suspending place W dirty.

As described above, although in the above embodiments, the clothing C is exemplified as an overall, the hanger of this invention can be used for hanging jackets or pants of working clothes, suits, sweaters, skirts, etc. A suspending place W to which the hanger is attached, other than the side surface of a steel locker, may be a steel plate-made door and a side surface of a steel book shelf in hospitals, construction vehicles such as cranes or the like at an exterior of construction sites, a steel wall in the site office of a prefabrication type, and further a steel wall may be attached for a display purpose as a suspending place W in a shop. Particularly, a site office of a prefabrication type in a construction site likely has few lockers, but is frequently made of steep plate walls, so that the walls can be advantageously utilized as a containing space in lieu of lockers when the hanger is used by being attached to the steel walls. When the attaching member A is used in which the attaching component 10 is made of screws, nails, or sticky tapes, the hanger can be attached to glass windows, wooden or concrete walls, and other surfaces to which any magnet does not attract.

The hanger of the invention is hung up as clamped between the suspending place W and the magnet while the clothing is engaged with the hanger body, because the first magnet is arranged in a projecting manner on the front side of the hanger body. Therefore, ventilation is ensured where a gap is formed between the clothing and the hanger. Because some gap is formed between the hanger body and the suspending place, a thick portion, formed due to overlapped clothes, can be contained in the gap, so that a case may not occur in which the hanger is detached due to the floated first magnet. Since the first magnet is arranged in a projecting manner on the rear side of the hanger body, the magnet can be partly separated from the suspending place by inclining the hanger body to render the magnet as a fulcrum based on the principle of levers, so that the hanger can be detached easily from the suspending place.

The clothing can be engaged without caring about the directionality of the hanger body even where the hanger is attached to the suspending place in any direction, where the hanger body is formed in a substantially circular shape to nullify the directionality of the hanger. The hanger also reduces labor for attachment because it is not necessary to care about the inclination and up and down sides of the hanger. The hanger also prevents clothing from sliding down or not engaging properly due to inclination of the hanger body. Since the magnet is solely arranged at around a center of the rear side of the hanger body, pushing any position of the hanger body enables the hanger body to be inclined due to the principle of levers (leverage) insofar as the position is away from the first magnet, thereby separating part of the first magnet from the suspending place, and thereby detaching the hanger from the suspending place easily. Since the hanger body is formed with a vent extending in the thickness direction, the air inside the clothing flows via the vent to improve air ventilation to the clothing. Because the hanger body is formed with a handle, the clothing can be engaged with the hanger as the handle is grasped, and the hanger can be attached to and detached from the suspending place, so that the controllability is improved.

Where the hanger having the attaching member of the invention is used, the hanger is attached to the suspending place via the attaching member, so that the first magnet of the hanger and the second magnet of the attaching member come to attract each other. Therefore, in comparison with a situation in which the hanger is attached to the suspending place directly, the hanger can be attached to the suspending place with a stronger attraction force. Where the projection is formed as projecting toward a side of the hanger at a position lower than the first magnet when the hanger is attached to the attaching member, the clothing is hooked up over the projection when the hanger on which the clothing is engaged is attached to the attaching member, so that the weight of the clothing is dispersed and so that the hanger is hardly detached or slips and falls off. In a case where the weight of the clothing is too heavy to keep the hanger at the surface of the attaching member, the projection can serve as a stopper to prevent the hanger from further slipping off. With the hanger, ventilation is further improved because a gap is formed between the suspending place and the clothing due to the thickness of the attaching member. Furthermore, even where perspiration, dust, chemicals, and germs are attached to the clothing, the hanger prevents the perspiration, germs, etc. from transferring, thereby preventing the suspending place from becoming dirty.

What is claimed is:

1. A hanger comprising:

a hanger body having a plate shape with a substantially circular outer configuration on which clothing is to be hung, and having a plurality of through-holes formed in said hanger body and extending in a thickness direction of said hanger body; and a magnet projecting from a rear side of said hanger body for attaching said hanger to a prescribed suspending location, said through-holes being arranged around said magnet, said magnet being located at a center of said hanger body.

2. The hanger of claim 1, wherein each of said through-holes is substantially circular.

3. The hanger of claim 1, wherein each of said through-holes is elongated and arc-shaped.

4. A hanger comprising:

a hanger body having a plate shape with a substantially circular outer configuration on which clothing is to be hung, and having a vent extending in a thickness direction thereof;

a magnet projecting from a rear side of said hanger body for attaching said hanger to a prescribed suspending location; and a handle projecting from a front side of said hanger body, said handle having an inner space and a perforated cap covering said inner space.

5. A hanger comprising:

a hanger body having a plate shape with a substantially circular outer configuration on which clothing is to be hung and having a plurality of through-holes formed in said hanger body and extending in a thickness direction of said hanger body; and a magnet projecting from a rear side of said hanger body for attaching said hanger to a prescribed suspending location said through-holes being arranged around said magnet;

wherein said through-holes are arranged to encircle said magnet.

6. The hanger of claim 5, wherein said magnet is located at a center of said hanger body.

7. A hanger comprising:

a hanger body having a plate shape with a substantially circular outer configuration on which clothing is to be hung, and having a vent extending in a thickness direction thereof;

a first magnet projecting from a rear side of said hanger body for attaching said hanger to a prescribed suspending location, said magnet being located only at a center of said substantially circular plate-shaped hanger body; and an attaching member for assisting attachment of said hanger to the suspending location, said attaching member including a second magnet arranged to attract and be attracted by said first magnet, said attaching member having a projection projecting toward said hanger body at a position lower than said first magnet when said hanger body is attached to said attaching member.

8. The hanger of claim 7, further comprising a handle projecting from a front side of said hanger body.

9. The hanger of claim 8, further comprising an attaching component for attaching said attaching member to the suspending location, said hanger being operable to attach to the suspending location via said attaching member and by the attraction between said first magnet and said second magnet.

10. The hanger of claim 7, further comprising an attaching component for attaching said attaching member to the suspending location, said hanger being operable to attach to the suspending location via said attaching member and by the attraction between said first magnet and said second magnet.

11. A hanger comprising:

a hanger body having a plate shape with a substantially circular outer configuration on which clothing is to be hung, and having a vent extending in a thickness direction thereof;

a first magnet projecting from a rear side of said hanger body for attaching said hanger to a prescribed suspending location;

a handle projecting from a front side of said hanger body; and an attaching member for assisting attachment of said hanger to the suspending location, said attaching member including a second magnet arranged to attract and be attracted by said first magnet, said attaching member having a projection projecting toward said hanger body at a position lower than said first magnet when said hanger body is attached to said attaching member.

12. The hanger of claim 11, further comprising an attaching component for attaching said attaching member to the suspending location, said hanger being operable to attach to the suspending location via said attaching member and by the attraction between said first magnet and said second magnet.

* * * * *